US011087904B2

(12) United States Patent
Kobayashi et al.

(10) Patent No.: US 11,087,904 B2
(45) Date of Patent: Aug. 10, 2021

(54) MULTICORE CABLE

(71) Applicant: SUMITOMO ELECTRIC INDUSTRIES, LTD., Osaka (JP)

(72) Inventors: Yuto Kobayashi, Tochigi (JP); Masaki Hayakawa, Tochigi (JP); Jun Otsuka, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/040,720

(22) PCT Filed: Mar. 26, 2019

(86) PCT No.: PCT/JP2019/013033
§ 371 (c)(1),
(2) Date: Sep. 23, 2020

(87) PCT Pub. No.: WO2019/194033
PCT Pub. Date: Oct. 10, 2019

(65) Prior Publication Data

US 2021/0012928 A1 Jan. 14, 2021

(30) Foreign Application Priority Data

Apr. 4, 2018 (JP) ..... JP2018-072538

(51) Int. Cl.
*H01B 11/02* (2006.01)
*H01B 11/20* (2006.01)
(Continued)

(52) U.S. Cl.
CPC ..... *H01B 11/20* (2013.01); *H01B 7/08* (2013.01); *H01B 7/1875* (2013.01)

(58) Field of Classification Search
CPC ..... H01B 7/02; H01B 7/08; H01B 7/0807; H01B 7/0823; H01B 7/0838;
(Continued)

(56) References Cited

U.S. PATENT DOCUMENTS 5,144,098 A * 9/1992 VanDeusen ..... H01B 11/1091 174/36
6,403,887 B1 6/2002 Kebabjian et al.
(Continued)

FOREIGN PATENT DOCUMENTS

JP 2002-304917 10/2002
JP 2002-304917 A * 10/2002 ..... H01B 7/08
(Continued)

*Primary Examiner* — William H. Mayo, III
(74) *Attorney, Agent, or Firm* — IPUSA, PLLC

(57) ABSTRACT

A multicore cable includes two-core parallel electric wires, wherein the two-core parallel electric wires each includes two conductors; an insulating layer that covers a periphery of the two conductors and having first and second flat portions and first and second semicircular portions; a first shield tape that covers a periphery of the insulating layer; a drain wire arranged inside the first shield tape; and a jacket that covers the first shield tape, wherein a cross-section of the insulating layer is an oval shape and has a groove at a portion at the first flat portion, wherein the drain wire is retained in the groove such that a portion of the drain wire protrudes toward the first shield tape with respect to the insulating layer, and wherein a twist pitch of twisting together the two-core parallel electric wires is shorter than 250 mm.

8 Claims, 9 Drawing Sheets

(51) Int. Cl.
*H01B 7/08* (2006.01)
*H01B 7/18* (2006.01)

(58) Field of Classification Search
CPC .... H01B 7/0861; H01B 7/0869; H01B 7/184; H01B 7/188; H01B 7/36; H01B 11/002; H01B 11/04; H01B 11/08; H01B 11/085; H01B 11/10; H01B 11/1016; H01B 11/1091
USPC ..... 174/102 R, 103, 106 R, 110 R, 113 R, 174/117 R, 117 F, 117 FF
See application file for complete search history.

(56) References Cited

U.S. PATENT DOCUMENTS

| | | | | |
|---|---|---|---|---|
| 9,349,508 | B2 * | 5/2016 | Nonen | H01B 11/20 |
| 9,583,235 | B2 * | 2/2017 | Nonen | H01B 11/20 |
| 10,204,717 | B2 * | 2/2019 | Tsujino | H01B 7/30 |
| 10,839,982 | B2 * | 11/2020 | Kobayashi | H01B 7/226 |
| 2011/0083877 | A1 * | 4/2011 | Sugiyama | H01P 11/001 174/115 |
| 2011/0100682 | A1 * | 5/2011 | Nonen | H01B 11/203 174/254 |
| 2016/0372235 | A1 * | 12/2016 | Sugiyama | H01B 11/002 |

FOREIGN PATENT DOCUMENTS

| | | | | |
|---|---|---|---|---|
| JP | 2003-297154 A | * | 10/2003 | H01B 11/00 |
| JP | 2015-072774 | | 4/2015 | |
| JP | 2015-072774 A | * | 4/2016 | H01B 11/06 |

* cited by examiner

MULTICORE CABLE

TECHNICAL FIELD

The present disclosure relates to a multicore cable.

The present application is based on and claims priority to Japanese Patent Application No. 2018-072538, filed on Apr. 4, 2018, the entire contents of the Japanese Patent Application being hereby incorporated herein by reference.

BACKGROUND ART

Patent Document 1 describes a data transmission cable having a pair of primary cables each including two conductors.

PRIOR ART DOCUMENT

Patent Document

[Patent Document 1] U.S. Pat. No. 6,403,887

SUMMARY OF THE INVENTION

A multicore cable according to one aspect of the present disclosure is a multicore cable including a plurality of two-core parallel electric wires such that the plurality of two-core parallel electric wires are twisted together, wherein the two-core parallel electric wires each includes two conductors arranged in parallel to a length direction of the two-core parallel electric wire;

an insulating layer that covers a periphery of the two conductors;

a first shield tape that covers a periphery of the insulating layer in a state of being longitudinally attached to the insulating layer;

a drain wire arranged inside the first shield tape; and a jacket that covers the first shield tape, wherein a cross-section of the insulating layer perpendicular to the length direction of the two-core parallel electric wire is an oval shape in which a length of a major axis is 1.7 times or more and 2.2 times or less a length of a minor axis and has a groove at a portion including an intersection point between an outline of the oval shape and a perpendicular bisector of the major axis, wherein the drain wire is retained in the groove such that a portion of the drain wire protrudes toward the first shield tape with respect to the insulating layer, and wherein a twist pitch of twisting together the two-core parallel electric wires is shorter than 250 mm.

EMBODIMENT FOR CARRYING OUT THE INVENTION

Figure 1:
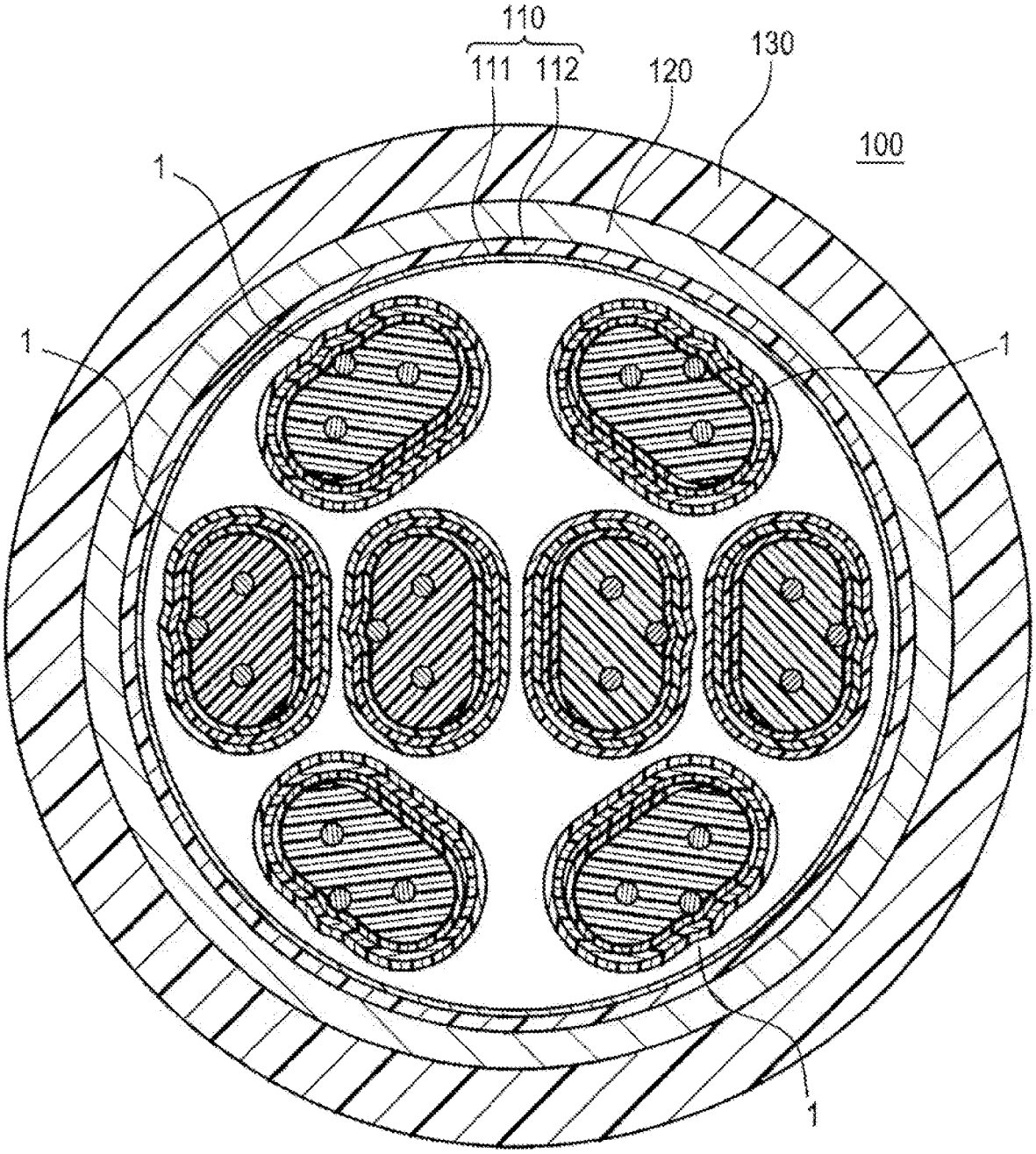
FIG. 1 is a cross-sectional view illustrating a configuration of a multicore cable according to one embodiment of the present disclosure.

Problem to be Solved by the Present Disclosure

In a multicore cable including a plurality of two-core parallel electric wires, there is room for improvement in order to enhance the electrical characteristics of the multicore cable.

The present disclosure has an object to provide a multicore cable that enables to enhance electrical characteristics.

Effect of the Present Disclosure

According to the present disclosure, it is possible to provide a multicore cable that enables to enhance electrical characteristics.

Outline of Embodiments

First, embodiments of the present will be described by listing.

(1) A multicore cable according to one aspect of the present disclosure is a multicore cable including a plurality of two-core parallel electric wires such that the plurality of two-core parallel electric wires are twisted together, wherein the two-core parallel electric wires each includes two conductors arranged in parallel to a length direction of the two-core parallel electric wire;

an insulating layer that covers a periphery of the two conductors;

a first shield tape that covers a periphery of the insulating layer in a state of being longitudinally attached to the insulating layer;

a drain wire arranged inside the first shield tape; and a jacket that covers the first shield tape, wherein a cross-section of the insulating layer perpendicular to the length direction of the two-core parallel electric wire is an oval shape in which a length of a major axis is 1.7 times or more and 2.2 times or less a length of a minor axis and has a groove at a portion including an intersection point between an outline of the oval shape and a perpendicular bisector of the major axis, wherein the drain wire is retained in the groove such that a portion of the drain wire protrudes toward the first shield tape with respect to the insulating layer, and wherein a twist pitch of twisting together the two-core parallel electric wires is shorter than 250 mm.

According to the multicore cable having the above described configuration, it is possible to constitute the multicore cable that is resistant to torsion, it is possible to easily stabilize the electrical characteristics of the multicore cable, and it is possible to enhance the electrical characteristics.

(2) In the multicore cable according to the above (1), the groove has a depth that is 0.5 times or more and 0.9 times or less an outer diameter or a thickness of the drain wire.

(3) In the multicore cable according to the above (1) or (2), a cross-section of the drain wire is circular, and the groove has a bottom surface having an arc shape along a side surface of the drain wire.

(4) In the multicore cable according to any one of the above (1) to (3), in a cross-section, the first shield tape overlaps, at a side surface of the insulating layer that is an opposite side of a surface having the groove, with a length of 0.7 times to 1.3 times a distance between centers of the two conductors.

(5) In the multicore cable according to any one of the above (1) to (4), wherein an outer periphery of the two-core parallel electric wire has a protrusion at a portion corresponding to the drain wire.

(6) In the multicore cable according to any one of the above (1) to (5), each of the two conductors is formed with a cross-sectional area of 0.16 mm or less.

According to the above described configuration, while maintaining flexibility that is required for the multicore cable, it is possible to provide the multicore cable that is resistant to torsion due to twisting together and of which electrical characteristics are easily stable.

Details of Embodiments of the Present Disclosure

Specific examples of multicore cables according to embodiments of the present disclosure will be described below with reference to the drawings.

It should be noted that the present disclosure is not limited to these examples, but is intended to include all modifications within the meaning and range equivalent to the scope of the claims.

Embodiments

Figure 2:
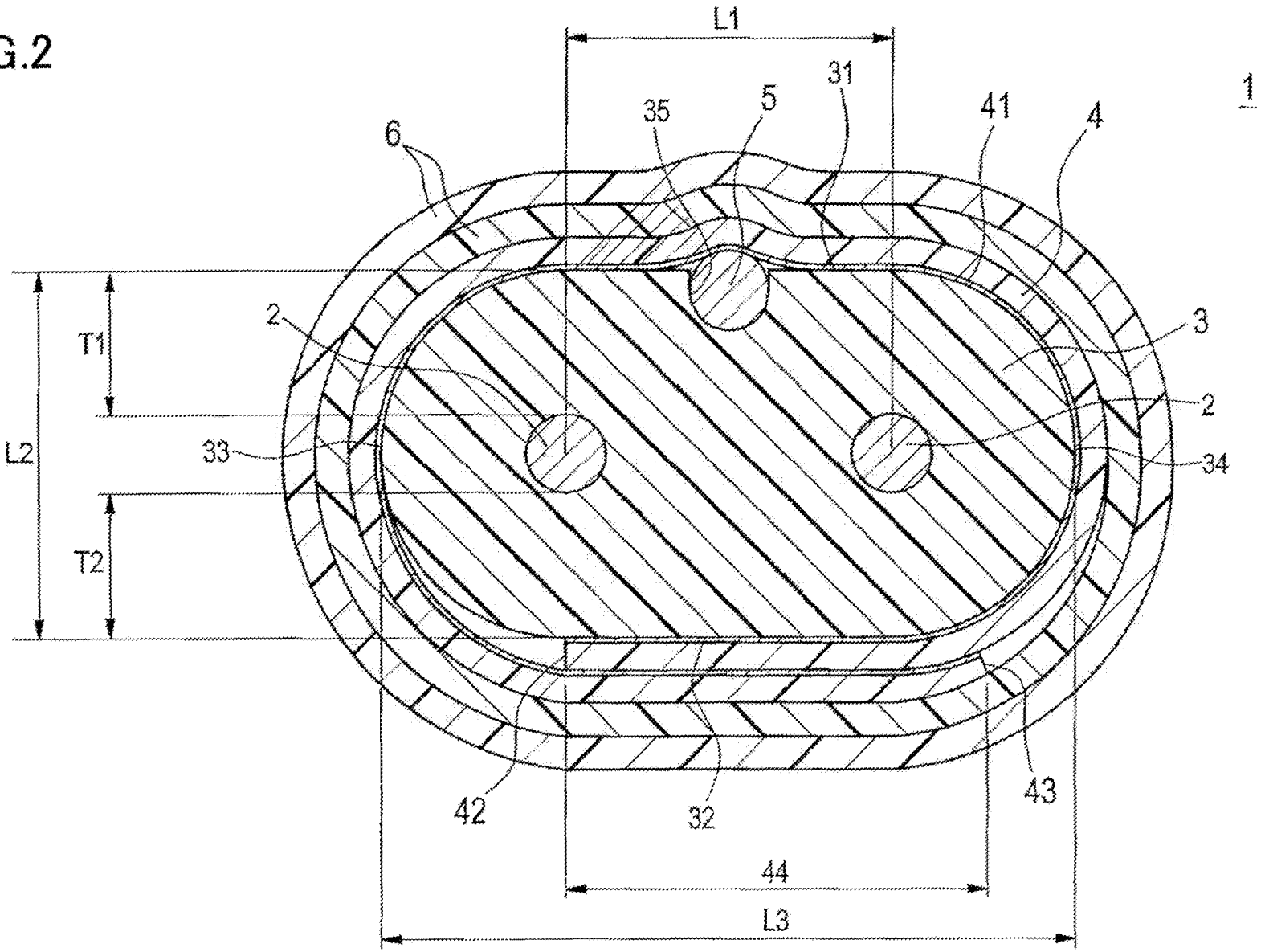
FIG. 2 is a cross-sectional view illustrating a configuration of a two-core parallel electric wire included in the multicore cable illustrated in FIG. 1.

FIG. 1 is a cross-sectional view illustrating a configuration of a multicore cable 100 according to one embodiment of the present disclosure. FIG. 2 is a cross-sectional view illustrating a configuration of a two-core parallel electric wire 1 included in the multicore cable 100. The multicore cable 100 can be used, for example, as an electric wire that is used in a communication device that transmits/receives digital data at high speed.

As illustrated in FIG. 1, the multicore cable 100 includes a plurality of two-core parallel electric wires 1, a second shield tape 110, a braid 120, and a jacket 130. In this example, the multicore cable 100 is formed by twisting together eight two-core parallel electric wires 1.

The second shield tape 110 is wound around the two-core parallel electric wires 1. The second shield tape 110 is formed of a resin tape-with-metal layer obtained by attaching or depositing a metal layer 111 on a resin tape 112. In the second shield tape 110, in this example, the metal layer 111 is arranged on the two-core parallel electric wires 1 side, and the resin tape 112 is arranged on the outside of the metal layer 111. The metal layer 111 is, for example, aluminum. The resin tape 112 is, for example, polyester.

It should be noted that the second shield tape 110 may be wound longitudinally or horizontally. Also, the second shield tape 110 is not limited to the configuration described above, but may have a configuration in which the resin tape 112 is arranged on the two-core parallel electric wires 1 side and the metal layer 111 is arranged on the outside of the resin tape 112.

The braid 120 is formed on the outer periphery of the second shield tape 110. The braid 120 is formed, for example, by braiding element wires of annealed tin-plated copper wires.

The jacket 130 is formed to cover the periphery of the braid 120. The jacket 130 is formed of a resin, such as PVC (vinyl chloride resin).

In this, because the plurality of two-core parallel electric wires 1 included in the multicore cable 100 have a same configuration, one of the eight two-core parallel electric wires 1 illustrated in FIG. 1 will be described below with reference to FIG. 2.

The two-core parallel electric wire 1 included in the multicore cable 100 includes two conductors 2 and an insulating layer 3 formed on the periphery of the two conductors 2, as illustrated in FIG. 2. Also, two-core parallel electric wire 1 includes a first shield tape 4 wound around the periphery of the insulating layer 3, a drain wire 5 disposed inside the first shield tape 4, and a jacket 6 formed to cover the first shield tape 4.

The two conductors 2 have structures that are substantially equal to each other and are arranged in parallel to the length direction of the two-core parallel electric wire 1. Here, L1 illustrated in FIG. 2 is the distance between the centers of the two conductors 2.

The conductor 2 is a single wire or a stranded wire formed of a conductor such as copper, aluminum, or an alloy mainly containing these, or formed of a conductor plated with tin, silver, or the like. The dimensions of the above conductors used for the conductors 2 are, in the AWG (American Wire Gauge) standard, MG 26 or less (cross-sectional area is less than or equal to 0.16 $mm^2$) and are preferably AWG 26 to AWG 36 (cross-sectional area is 0.01 $mm^2$ to 0.16 $mm^2$). In this example, the cross-sectional area of the conductor 2 is 0.128 mm. In this manner, by making the cross-sectional area of the conductor 2 less than or equal to 0.16 mm (less than or equal to AWG 26), flexibility such as bending depending on the location or shape for which the multicore cable 100 is used can be maintained, and thus the electrical characteristics of the multicore cable 100 are easily stabilized.

The insulating layer 3 that covers the periphery of the two conductors 2 is made of a thermoplastic resin with a low dielectric constant, such as polyolefin. The insulating layer 3 is formed, for example, by being supplied from an extruder, extrusion-shaped, and being coated on the conductors 2 at once. The insulating layer 3 is formed with an oval shape in a cross-section perpendicular to the length direction of the two-core parallel electric wire 1. In this manner, by forming the insulating layer 3 by extrusion-covering the periphery of the two conductors 2, it is possible to constitute the multicore cable 100 that is resistant to torsion that occurs when the two parallel electric wires 1 are twisted together.

It should be noted that in the present specification, a "cross-section" means a cross-section viewed from the longitudinal direction of a two-core parallel electric wire. Also, the "oval shape" means a shape such as an ellipse shape, a koban shape obtained by flattening a circle, and a shape in which two parallel lines are connected by an arc-shaped curve.

When the direction in which the two conductors 2 are arrayed in a cross-section of the insulating layer 3 is defined as the left and right direction and the direction perpendicular to the left and right direction is defined as the upper and lower direction, the insulating layer 3 has, on the upper and lower sides of the two conductors 2, flat portions 31 and 32 that extend in the left and right direction. Also, the insulating layer 3 has semicircular portions 33 and 34 on the right and left sides of the two conductors 2.

The cross-section of the insulating layer 3 is formed as an oval shape such that the length of the major axis L3 is 1.7 times or more and 2.2 times or less the length of the minor axis L2. More preferably, the cross-section of the insulating layer 3 is formed as an oval shape such that the length of the major axis L3 is twice the length of the minor axis L2. In this example, the oval shape in the cross-section of the insulating layer 3 is, for example, about major axis 3.14 mm×minor axis 1.57 mm in the system of AWG 26, about major axis 2.24 mm×minor axis 1.12 mm in the system of AWG 28, about major axis 1.80 mm×minor axis 0.90 mm in the system of AWG 30, and about major axis 0.78 mm×minor axis 0.39 mm in the system of AWG 36.

Here, a thickness deviation rate of the insulating layer 3 in the thickness direction (the upper and lower direction in FIG. 2) will be described. The thickness deviation rate in the thickness direction is the ratio of the minimum value of the thickness/the maximum value of the thickness for the thickness T1 and the thickness T2 of the insulating layer 3 at the upper side and the lower side of the conductor 2, respectively. For the thickness deviation rate, it is preferable that, in the length direction of the two-core parallel electric wire 1, the minimum value/the maximum value of the thickness of the insulating layer 3 is a value that is close to 1.0. In a case in which the thickness deviation rate of the insulating layer 3 in the thickness direction is 1.0, the thickness T1 and the thickness T2 of the insulating layer 3 are the same. In a case in which the thickness T1 and the thickness T2 of the insulating layer 3 are the same, the two-core parallel electric wire 1 has favorable electrical characteristics. The thickness deviation rate of the insulating layer 3 can be made close to 1.0 by adjusting the extrusion conditions of the insulating resin. The thickness deviation rate can be adjusted, for example, by adjusting the resin pressure at the time of extruding the insulating resin, the speed of a screw, the linear speed of the conductor 2, the shape of a resin passage, and the like.

The electrical characteristics of the two-core parallel electric wire 1 deteriorates when the thickness deviation rate of the insulating layer 3 in the thickness direction is small. The thickness deviation rate of the insulating layer 3 that is allowable in terms of favorable electrical characteristics is greater than or equal to 0.85. The thickness of the insulating layer 3 may vary in the length direction of the two-conductor parallel electric wire 1. In order to stabilize the electrical characteristics of the two-core parallel electric wire 1, it is preferable that the variation of the thickness of the insulating layer 3 in the length direction is small. A preferable thickness deviation rate, which is in consideration of the variation in the thickness of the insulating layer 3, is greater than or equal to 0.85 and less than or equal to 1.0 in the range of the length 5 m of the two-core parallel electric wire 1. In this example, the insulating layer 3 is formed such that the minimum value/the maximum value of the thickness of the insulating layer 3 positioned at the upper and lower sides of at least one of the two conductors 2 is greater than or equal to 0.85 and less than or equal to 1.0 in the range of a length 5 m of the two-core parallel electric wire 1.

The insulating layer 3 has a groove 35 at a portion including the intersection point between the outline of the oval shape and the perpendicular bisector of the major axis L3. While grooves 35 may be formed on both of the flat portions 31 and 32, it is preferable to form a groove 35 on either the flat portion 31 or 32 in order to further enhance electrical properties. In this example, the groove 35 is formed on the flat portion 31 as illustrated in FIG. 2.

The groove 35 is formed in a shape in accordance with the outline of the drain wire 5. In a case in which the cross-sectional shape of the drain wire 5 is circular, the bottom portion of the groove 35 is formed in an arc shape along the drain wire 5. In other words, the groove 35 has a bottom surface having an arc shape along the side surface of the drain wire 5. In a case in which the cross-section of the drain wire 5 is, for example, rectangular that is not circular, the bottom portion of the groove 35 is formed to be rectangular.

Also, the groove 35 has a depth that is 0.5 times or more and 0.9 times or less the outer diameter or the thickness of the drain wire 5. In a case in which the depth of the groove 35 is less than 0.5 times the outer diameter or the thickness of the drain wire 5, the drain wire 5 may come off the groove 35 and meander. When the depth of the groove 35 is greater than 0.9 times the outer diameter or the thickness of the drain wire 5, the drain wire 5 may excessively get into the groove 35 and the contact state with the first shield tape 4 may be unstable, resulting in unstable electrical characteristics of the two-core parallel electric wire 1.

It is more preferable that the depth of the groove 35 is 0.6 times or more and 0.8 times or less the outer diameter or the thickness of the drain wire 5. It is further more preferable that the depth of the groove 35 is 0.7 times the outer diameter or thickness of the drain wire 5. In this example, the groove 35 is formed such that the bottom portion of the groove 35 is formed in an arc shape along the drain wire 5 that is circular in the cross-section, and the depth of the deepest portion is about 0.18 mm (0.72 times the outer diameter of the drain wire). By forming the groove 35 with such a depth, the drain wire 5 is retained in the groove 35 so as to protrude toward the first shield tape 4 with respect to the insulating layer 3 to be reliably in contact with the first shield tape 4.

The first shield tape 4 is formed of a resin tape-with-metal layer obtained by attaching or depositing a metal layer 41, such as aluminum, on a resin tape, such as polyester. The first shield tape 4 is wound longitudinally around the periphery of the insulating layer 3 and the outside of the drain wire 5. In other words, the first shield tape 4 covers the periphery of the insulating layer 3 in a state of being longitudinally attached to the insulating layer 3. The first shield tape 4 has an overlapping portion 44 that overlaps and covers an area from a winding start position 42 to a winding end position 43 of the first shield tape 4. The overlapping portion 44 is arranged on either the flat portion 31 or 32 of the insulating layer 3. In this example, as illustrated in FIG. 2, the overlapping portion 44 is arranged on the flat portion 32 that is opposite to the groove 35.

The overlapping portion 44 is formed such that the length in the left and right direction (the left and right direction in FIG. 2) is 0.7 times to 1.3 times the interval L1 between the centers of the two conductors 2. In other words, in the cross-section, the first shield tape 4 overlaps, at the side surface of the insulating layer 3 that is the opposite side of the surface having the groove 35, with a length of 0.7 times to 1.3 times the distance L1 between the centers of the two conductors 2. By having such a configuration, the electrical characteristics of the two-core parallel electric wire 1 are easily stabilized.

The first shield tape 4 is wound such that the metal layer 41 is directed toward the insulating layer 3 and the drain wire 5. In this example, the first shield tape 4 is wound to cover the insulating layer 3 and the drain wire 5 in a longitudinal manner. The winding start position 42 and the winding end position 43 of the first shield tape 4 are wound to be parallel to the length direction of the two-core parallel electric wire 1.

The first shield tape 4 may maintain a shape such that the first shield tape 4 is wound, by providing an adhesive on the overlapping portion 44 and by bonding, with the adhesive, the first shield tape 4 at the overlap portion 44.

The drain wire 5 is a conductor wire such as, for example, copper or aluminum. The drain wire 5 is positioned inside the first shield tape 4, is longitudinally attached in a direction parallel to the longitudinal direction of the two-core parallel electric wire 1 (the depth direction of the plane of paper of FIG. 1) and is retained in the groove 35 of the insulating layer 3. The cross-sectional shape of the drain wire 5 may be circular or rectangular.

In this example, the drain wire 5 is an annealed tin-plated copper wire and has a circular shape in a cross-section. The diameter of the drain wire 5 is, for example, 0.18 mm to 0.3 mm. In this example, in the system of AWG 26, the depth of the groove 35 is about 0.18 mm as described above and the diameter of the drain wire 5 is about 0.25 mm. Therefore, the drain wire 5 is retained in the groove 35 such that a portion of the drain wire 5 (in this example, about 0.07 mm in the system of AWG 26) protrudes toward the first shield tape 4 with respect to the flat portion 31 of the insulating layer 3. Also, the outer periphery of the two-core parallel electric wire 1 has a protrusion at the portion corresponding to the drain wire 5.

By having such a configuration, because the metal layer 41 of the first shield tape 4 is reliably in contact with the drain wire 5, the electrical characteristics of the two-core parallel electric wire 1 are easily stabilized. Also, because the drain wire 5 is retained in the groove 35, the drain wire 5 is prevented from meandering on the insulating layer 3. This enhances the electrical characteristics of the two-core parallel electric wires 1.

The jacket 6 is formed of a resin tape, such as polyester. The jacket 6 is wound, for example, in a spiral manner (in a horizontal winding) to cover the outer periphery of the first shield tape 4. The resin that constitutes the jacket 6 may be crosslinked to enhance the heat resistance. In this example, the jacket 6 is formed by horizontally winding a polyester tape twice in the same direction. It should be noted that in a case in which a resin tape is wound twice to form the jacket 6, the winding directions are not limited to the same direction and may be the opposite directions.

It should be noted that although the groove 35 in formed only on the flat portion 31 in this example, the grooves 35 may be formed for the respective flat portions 31 and 32, from the viewpoint of easily adjusting the characteristic impedance of the two-core parallel electric wire and from the viewpoint of easily manufacturing the insulating layer 3. In a case in which the grooves 35 are formed on the respective flat portions 31 and 32, the drain wire 5 is arranged on one groove or each of both grooves. In a case in which the drain wire 5 is arranged in one of the grooves 35, the groove 35 at which the drain wire 5 is not arranged is covered with the first shield tape 4 that is in a tensioned state so as not to wrinkle. By having such a configuration, it is possible to prevent the first shield tape 4 from getting into the groove 35 to deteriorate electrical characteristics.

Figure 3:
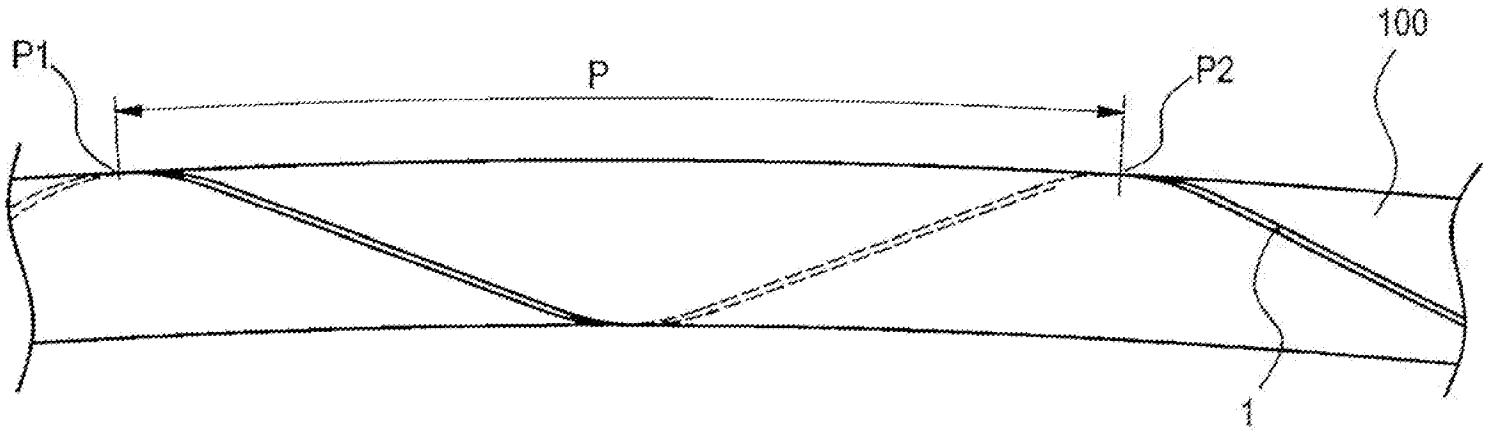
FIG. 3 is a schematic diagram that describes a twist pitch of the multicore cable.

FIG. 3 is a schematic diagram illustrating a state in which a plurality of two-core parallel electric wires 1 included in the multicore cable 100 are twisted together. In FIG. 3, the numeral 1 indicates one of the eight two-core parallel electric wires 1 included in the multicore cable 100 in a state in which the second shielded tape 110, the braid 120, and the jacket 130 of the multicore cable 100 are removed.

As illustrated in FIG. 3, the two-core parallel electric wires 1 are helically twisted together to rotate in one direction. The plurality of two-core parallel electric wires 1 may be twisted together in one twisting direction (S twist or Z twist), or the twisting direction may be reversed (SZ twist) in the longitudinal direction.

When the two-core parallel electric wires 1 rotate in the circumferential direction in the cross-sectional view of the multicore cable 100 from a position P1 to a position P2 that overlaps the position P1 again, the length from P1 to P2 in the longitudinal direction is a period of the twist pitch P of the two-core parallel electric wire 1. Here, the twist pitch P is shorter than 250 mm. In this example, the twist pitch P is 175 mm.

Here, multicore cables that are used, for example, for high-speed communication, are required to have better electrical characteristics. Such a multicore cable is constituted by twisting together a plurality of two-core parallel electric wires, which are signal wires used for high-speed communication. In a case in which electric wires to be twisted together are two-core parallel electric wires obtained by combining two single-core wires, the two-core parallel electric wires cause torsion due to being twisted together. Due to this torsion, the two single-core wires in the two-core parallel electric wires may move individually. If the single-core wires move individually, the electrical characteristics of a multicore cable including the two-core parallel electric wires may be insufficient.

Accordingly, the inventors of the present invention investigated the configuration of a multicore cable including a plurality of two-core parallel electric wires and found that the electrical characteristics are favorable in the multicore cable 100 using a plurality of two-core parallel electric wires 1 each including an insulation layer 3 formed by extrusion-covering the periphery of the two conductors 2 at once.

Further, the inventors of the present invention have examined the twist pitch P of the multicore cable 100. Then, it has been found that, for the multicore cable 100 of which the twist pitch P of the plurality of two-core parallel electric wires 1 is shorter than 250 mm, the electrical characteristics are favorable.

Table 1 indicates the relationship between the electrical characteristics (Scd21, Scd21-Sdd21) and the twist pitch P of the two-core parallel electric wires 1 it should be noted that Scd21 is a conversion amount from the differential mode to the common mode at port 2 from port 1, and is one of the mix mode S parameters. Also, Scd21-Sdd21 is a common mode output with respect to a differential mode output. In Table 1, A indicates that electrical characteristics were poor, B indicates that electrical characteristics were slightly poor, C indicates that electrical characteristics were favorable, and D indicates that electrical characteristics were further favorable.

TABLE 1

| TWIST PITCH P | ELECTRICAL CHARACTERISTICS |
|---|---|
| 300 mm | A |
| 275 mm | A |
| 250 mm | B |
| 225 mm | C |
| 200 mm | C |
| 175 mm | D |
| 150 mm | D |

As indicated in Table 1, it was found that, in multicore cables with a twist pitch P shorter than 250 mm, the electrical characteristics were C (favorable) or D (further favorable). It was found that, in multicore cables with a twist pitch P of 225 mm or less, the electrical characteristics were C (favorable) and in multicore cables with a twist pitch P of 175 mm or less, the electrical characteristics were D (further favorable).

As described above, according to one aspect of the present disclosure, the multicore cable 100 includes a plurality of two-core parallel electric wires 1 each including an insulating layer 3 formed by extrusion-covering the periphery of two conductors 2 at once. Therefore, in each of the eight two-core parallel electric wires 1 included in the multicore cable 100, it is possible to prevent the two conductors 2 from moving individually, and it is possible to constitute a multicore cable that is resistant to torsion. Thereby, it is possible to enhance the electrical characteristics of the multicore cable 100, because the electrical specifications of the multicore cable 100 are easily stabilized. Also, it has been found that, for the multicore cable 100 of which the twist pitch P is shorter than 250 mm, the electrical characteristics are favorable. Thereby, it is possible to provide the multicore cable 100 with enhanced electrical characteristics.

In addition, in the multicore cable 100 according to one aspect of the present disclosure, each of the two conductors 2 of the two-core parallel electric wire 1 is formed with a cross-sectional area of 0.128 $mm^2$ or less. According to the above described configuration, while maintaining flexibility that is required for the multicore cable, it is possible to provide the multicore cable that is resistant to torsion due to twisting together and of which electrical characteristics are easily stable.

Figure 4:
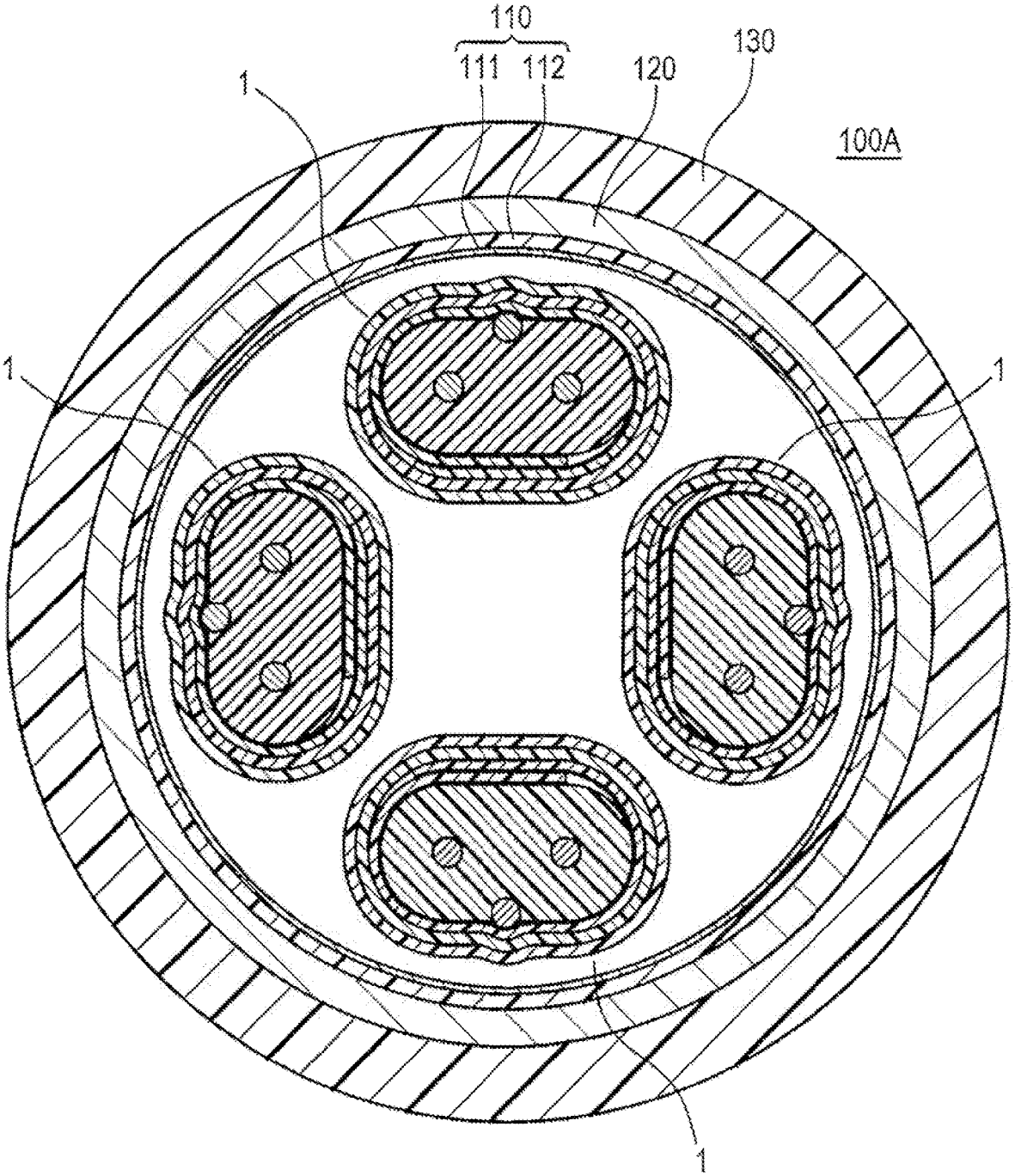
FIG. 4 is a cross-sectional view illustrating a configuration of a multicore cable according to another embodiment.
Figure 5:
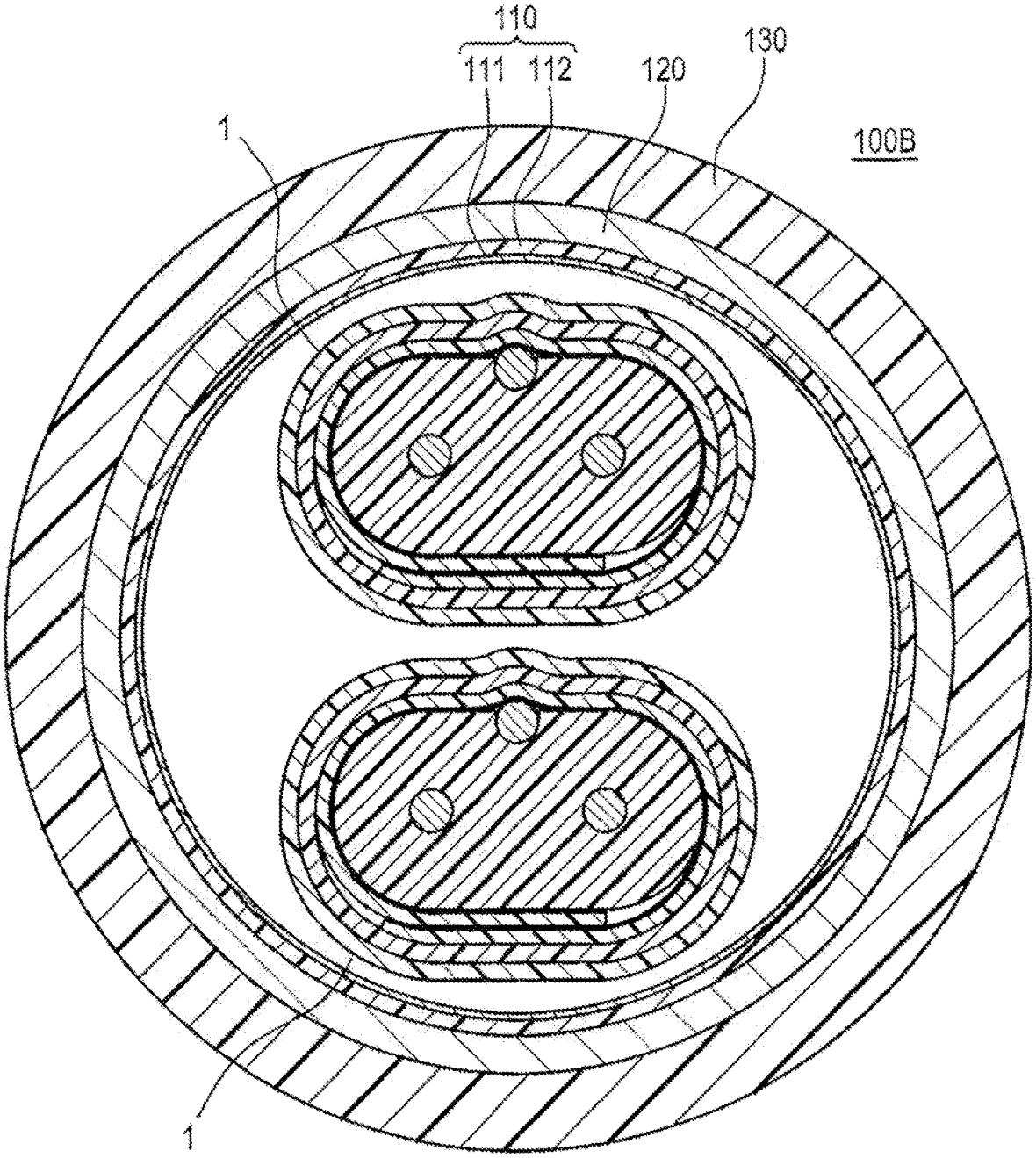
FIG. 5 is a cross-sectional view illustrating a configuration of a multicore cable according to another embodiment.

It should be noted that the number of two-core parallel electric wires 1 of the multicore cable 100 is not limited to eight wires described in the above embodiment. For example, it may be a multicore cable 100A including four two-core parallel electric wires 1 illustrated in FIG. 4, or it may be a multicore cable 100B including two two-core parallel electric wires 1 illustrated in FIG. 5. Because the configurations of the multicore cables 100A and 100B are the same as the configuration of the multicore cable 100 illustrated in FIG. 1 to FIG. 3, except for the number of two-core parallel electric wires 1, the repetitive description is omitted by attaching the same reference numerals to FIG. 4 and FIG. 5.

Next, Example of the present disclosure will be described. The following Example and Comparative Example of two-core parallel electric wires were prepared, and a test for electrical characteristics (Scd21, Scd21-Sdd21) was conducted for each of the two parallel electric wires.

EXAMPLES

The configuration of the multicore cable 100 of Example is the configuration of the first embodiment illustrated in FIG. 1 to FIG. 3, and was set as follows.

Two copper wires of AWG 26 (conductors 2 of 0.41 mm in diameter and 0.16 $mm^2$ in cross-sectional area) were arranged in parallel and its periphery was integrally covered with a polyolefin (insulating layer 3) by extrusion molding. The insulating layer 3 was formed to have an oval shape in a cross-section having a major axis of 2.74 mm×a minor axis of 1.37 mm. On the upper flat portion 31 of the insulating layer 3, a groove 35 was formed in which the bottom portion was an arc-shaped and the depth of the deepest portion was 0.18 mm.

An annealed tin-plated copper wire was formed to have a circular shape in a cross-section to form a drain wire 5 having a diameter of 0.25 mm. A single drain wire 5 was arranged in the groove 35 of the insulating layer 3. The drain wire 5 was retained in the groove 35 such that a portion (0.07 mm) of the drain wire 5 protrudes toward the first shield tape 4 with respect to the flat portion 31 of the insulating layer 3.

Aluminum was deposited on a polyester resin tape using a vacuum deposition method to form an aluminum deposited polyester resin tape (first shield tape 4). The first shield tape 4 was wound longitudinally on the outer peripheral surface of the insulating layer 3 and the drain wire 5 so that the surface of aluminum of the first shield tape 4 was arranged inwardly. Two polyester tapes were spirally wound around the outside of the first shield tape 4 to form the jacket 6.

Eight two-core parallel electric wires 1 configured as described above were assembled and twisted together with a twist pitch P of 175 m. A second shielded tape 110 was wound on the periphery of the eight two-core parallel electric wires 1. A braid 120 was formed on the outer periphery of the second shield tape 110, a jacket 130 was formed on the periphery of the braid 120, and a multicore cable 100 was formed.

With a length of 5 m of the multicore cable 100 of Example having the above-described configuration, and high frequency signals of 0 GHz to 19 GHz were transmitted to determine the electrical characteristics (Scd21, Scd21-Sdd21).

Comparative Example

In Comparative Example, eight two-core parallel electric wires were assembled and twisted together with a twist pitch of 300 mm to form a multicore cable. The other configurations were similar to those of Example.

(Test Results)

For Example and Comparative Example described above, results of electrical characteristics (Scd21, Scd21-Sdd21) of respective ten examples were compared.

(Test Results of Electrical Characteristics (Scd21))

Figure 6:
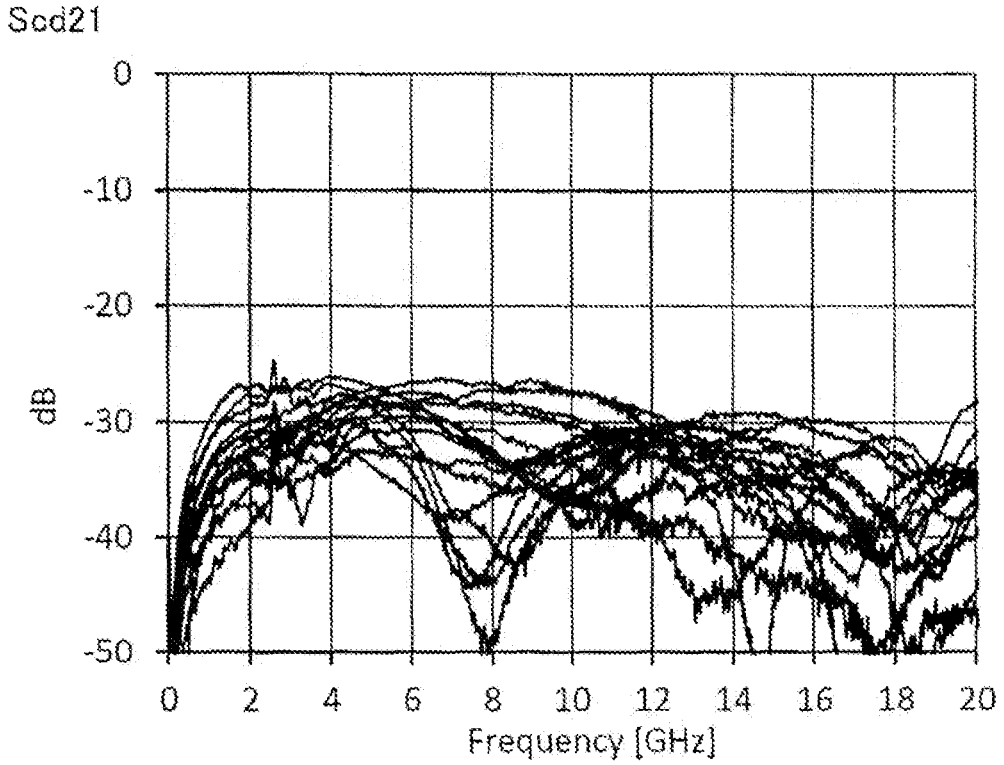
FIG. 6 is a diagram that describes electrical characteristics (Scd21) of Example.
Figure 7:
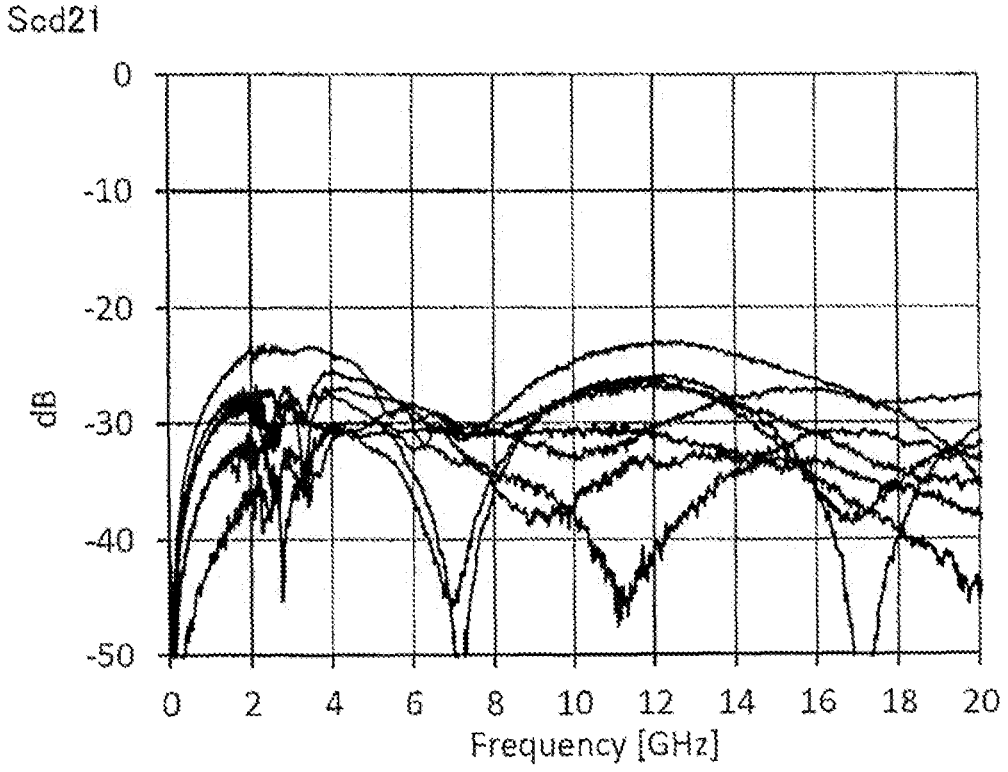
FIG. 7 is a diagram that describes electrical characteristics (Scd21) of Comparative Example.

The electrical characteristics (Scd21) of Example are illustrated in FIG. 6, and the electrical characteristics (Scd21) of Comparative Example are illustrated in FIG. 7.

Comparing FIG. 6 and FIG. 7 for the electrical characteristics (Scd21), the maximum value at 8 GHz to 18 GHz was −22 dB in Comparative Example as illustrated in FIG. 7, while the maximum value of that in Example was −27 dB maximum as illustrated in FIG. 6. In this manner, in Example, the maximum value at 8 GHz to 18 GHz was suppressed at a value lower by 5 dB than that of Comparative Example, and the electrical characteristics were favorable.

Also, for variations in each example, although Comparative Example had a variation in −27 dB to −22 dB as illustrated in FIG. 7, Example did not have a variation greater than −27 dB as illustrated in FIG. 6, and the electrical characteristics (Scd21) of Example were favorable.

(Test Results of Electrical Characteristics (Scd21-Sdd21)

Figure 8:
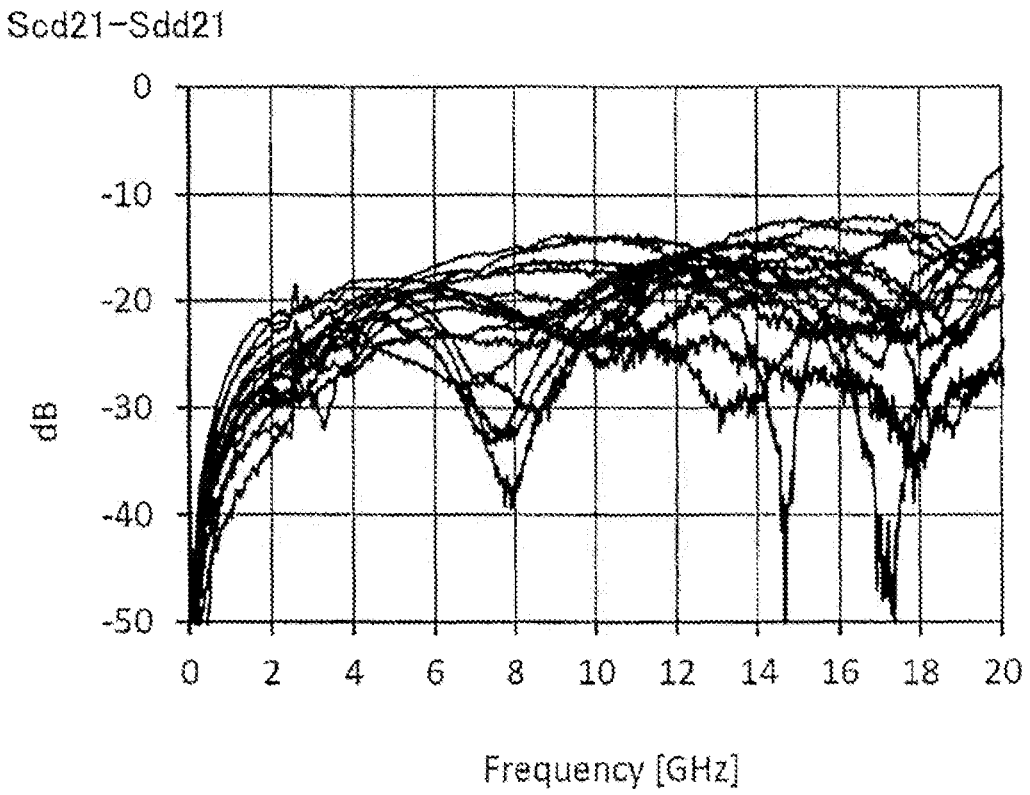
FIG. 8 is a diagram that describes electrical characteristics (Scd21-Sdd21) of Example.
Figure 9:
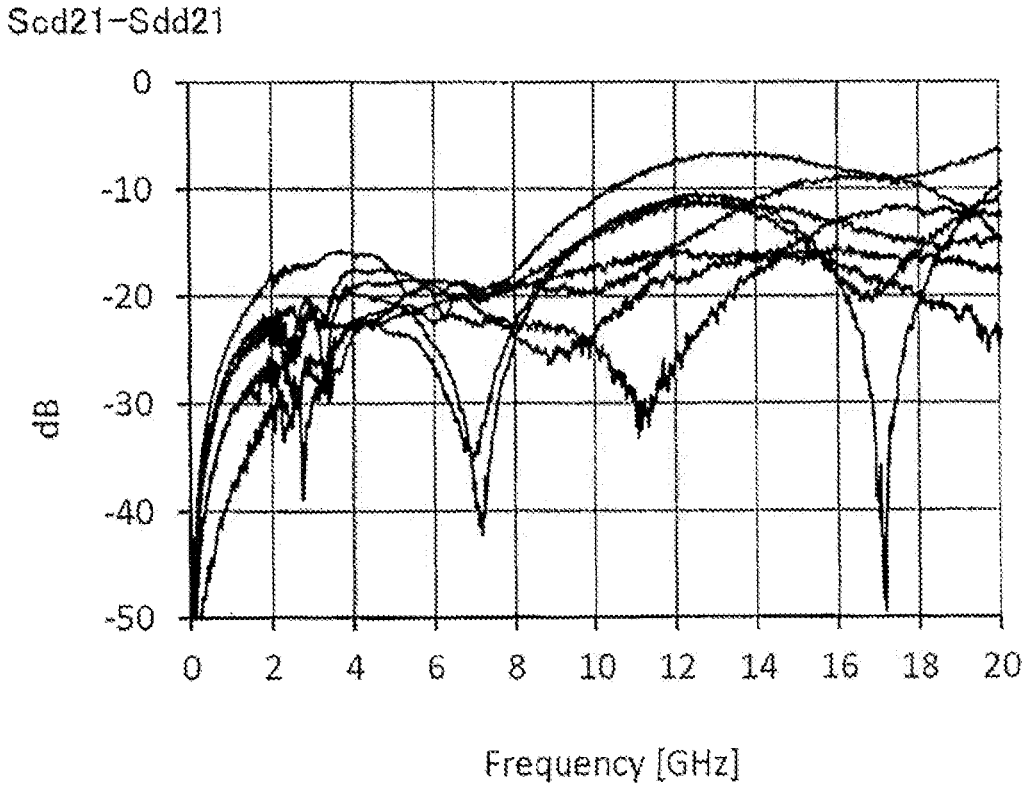
FIG. 9 is a diagram that describes electrical characteristics (Scd21-Sdd21) of Comparative Example.

The electrical characteristics (Scd21-Sdd21) of Example are illustrated in FIG. 8, and the electrical characteristics (Scd21-Sdd21) of Comparative Example are illustrated in FIG. 9. The electrical characteristics (Scd21-Sdd21) are favorable in a case in which the maximum value is less than or equal to −10 dB.

In Comparative Example, as illustrated in FIG. 9, the maximum value at 10 GHz to 20 GHz was −6 dB, which is greater than −10 dB, and the electrical characteristics were not favorable. In Example, as illustrated in FIG. 8, the maximum value was −12 dB, which is less than or equal to −10 dB, and the electrical characteristics of Example were favorable.

For the variation in each example, at −10 dB to 10 GHz and 20 GHz, Comparative Example had a variation in a range greater than −1 dB as illustrated in FIG. 9. Example illustrated in FIG. 8 had no variations greater than −12 dB at 0 GHz to 19 GHz, the electrical characteristics (Scd21-Sdd21) of Example were favorable.

From the above results, it can be confirmed that a multicore cable 100 constituted with the twist pitch of P175 mm has better electrical characteristics (Scd21, Scd21-Sdd21) than those of a multicore cable 100 constituted with the twist pitch of 300 mm.

Although the present disclosure has been described in detail above with reference to specific embodiments, it is be apparent to those skilled in the art that various changes and modifications may be made without departing from the spirit and scope of the present disclosure. Further, the number, position, shape, and the like of the components described above are not limited to the above described embodiments, and the number, position, shape, and the like may be changed as suited for carrying out the present disclosure.

DESCRIPTION OF THE REFERENCE NUMERALS

1 two-core parallel electric wire
2 conductor
3 insulation layer
4 first shield tape
5 drain wire
6 jacket
31, 32 flat portion
33, 34 semicircular portion
35 groove
41 metal layer
42 winding start position
43 winding end position
44 overlapping portion
100, 100A, 100B multicore cable
110 second shield tape
111 metal layer
112 resin tape
120 braid
130 jacket
L1 distance (between centers of conductors 2)
L2 minor axis
L3 major axis

The invention claimed is:

1. A multicore cable including a plurality of two-core parallel electric wires such that the plurality of two-core parallel electric wires are twisted together, wherein the two-core parallel electric wires each includes two conductors arranged in parallel to a length direction of the two-core parallel electric wire;

an insulating layer that covers a periphery of the two conductors;

a first shield tape that covers a periphery of the insulating layer in a state of being longitudinally attached to the insulating layer;

a drain wire arranged inside the first shield tape; and a jacket that covers the first shield tape, wherein when a direction in which the two conductors are arrayed in a cross-section of the insulating layer is defined as a left and right direction and a direction perpendicular to the left and right direction is defined as an upper and lower direction, the insulating layer has, on upper and lower sides of the two conductors, a first flat portion that extends in the left and right direction and a second flat portion opposite to the first flat portion, the insulating layer having, on right and left sides of the two conductors, a first semicircular portion and a second semicircular portion opposite to the first semicircular portion, wherein a cross-section of the insulating layer perpendicular to the length direction of the two-core parallel electric wire is an oval shape in which a length of a major axis is 1.7 times or more and 2.2 times or less a length of a minor axis and has a groove at the first flat portion that is a portion including an intersection point between an outline of the oval shape and a perpendicular bisector of the major axis, wherein the drain wire is retained in the groove such that a portion of the drain wire protrudes toward the first shield tape with respect to the insulating layer, wherein each of the two conductors is formed with a cross-sectional area of 0.16 $mm^2$ or less, and wherein a twist pitch of twisting together the two-core parallel electric wires is shorter than 250 mm.

2. The multicore cable according to claim 1, wherein the groove has a depth that is 0.5 times or more and 0.9 times or less an outer diameter or a thickness of the drain wire.

3. The multicore cable according to claim 1, wherein a cross-section of the drain wire is circular, and Wherein the groove has a bottom surface having an arc shape along a side surface of the drain wire.

4. The multicore cable according to claim 1, wherein, in a cross-section, the first shield tape overlaps, at a side surface of the insulating layer that is an opposite side of a surface having the groove, with a length of 0.7 times to 1.3 times a distance between centers of the two conductors.

5. The multicore cable according to claim 1, wherein an outer periphery of the two-core parallel electric wire has a protrusion at a portion corresponding to the drain wire.

6. The multicore cable according to claim 1, wherein the first shield tape has an overlapping portion that overlaps and covers an area from a winding start position to a winding end position, and wherein the overlapping portion is arranged at the second flat portion.

7. The multicore cable according to claim 1, further comprising:

another drain wire arranged at a groove formed on the second flat portion.

8. The multicore cable according to claim 1, wherein the conductors are copper wires, and wherein the drain wire is a tin-plated copper wire.

* * * * *